US010607825B2

(12) United States Patent
Yoshinari et al.

(10) Patent No.: US 10,607,825 B2
(45) Date of Patent: Mar. 31, 2020

(54) MASS SPECTROMETER

(71) Applicant: Hitachi High-Technologies Corporation, Minato-ku, Tokyo (JP)

(72) Inventors: Kiyomi Yoshinari, Tokyo (JP); Yasushi Terui, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 15 days.

(21) Appl. No.: 16/060,132

(22) PCT Filed: Nov. 9, 2016

(86) PCT No.: PCT/JP2016/083150

§ 371 (c)(1),
(2) Date: Jun. 7, 2018

(87) PCT Pub. No.: WO2017/104303

PCT Pub. Date: Jun. 22, 2017

(65) Prior Publication Data

US 2019/0006164 A1 Jan. 3, 2019

(30) Foreign Application Priority Data

Dec. 17, 2015 (JP) ..... 2015-245783

(51) Int. Cl.
*H01J 49/00* (2006.01)
*H01J 49/06* (2006.01)
*H01J 49/42* (2006.01)

(52) U.S. Cl.
CPC ..... *H01J 49/063* (2013.01); *H01J 49/005* (2013.01); *H01J 49/4215* (2013.01)

(58) Field of Classification Search
CPC ..... H01J 49/063; H01J 49/005; H01J 49/4215
(Continued)

(56) References Cited

U.S. PATENT DOCUMENTS 5,847,386 A * 12/1998 Thomson ..... H01J 49/005 250/288
8,314,384 B2 11/2012 Stoermer et al.
(Continued)

FOREIGN PATENT DOCUMENTS

CN 104011828 A 8/2014
DE 10 2010 022 184 A1 11/2011
(Continued)

OTHER PUBLICATIONS

International Search Report (PCT/ISA/210) issued in PCT Application No. PCT/JP2016/083150 dated Feb. 7, 2017 with English-language translation (Six (6) pages).
(Continued)

*Primary Examiner* — Michael Maskell
(74) *Attorney, Agent, or Firm* — Crowell & Moring LLP

(57) ABSTRACT

Acceleration of decelerated ions and a reduction in the velocity dispersion width of decelerated ions are both achieved, whereby the sensitivity of detected ion sensitivity is improved and resolution is improved. The distance dx between at least one set of facing rod-shaped electrodes among rod-shaped electrodes (4-2-*a*) to (4-2-*d*) differs at the inlet part at which ions enter and the outlet part at which ions exit, and the distance dx between the at least one set of facing rod-shaped electrodes is gradually reduced or increased from the inlet part toward the outlet part.

13 Claims, 19 Drawing Sheets

(58) Field of Classification Search
USPC ..... 250/281, 282, 297
See application file for complete search history.

(56) References Cited

U.S. PATENT DOCUMENTS

| | | | | |
|---|---|---|---|---|
| 9,099,290 | B2 | 8/2015 | Jung et al. | |
| 2005/0258362 | A1* | 11/2005 | Collings | H01J 49/4225 250/290 |
| 2011/0049360 | A1 | 3/2011 | Schoen | |
| 2011/0284741 | A1 | 11/2011 | Stoermer et al. | |
| 2015/0102215 | A1* | 4/2015 | Jung | H01J 49/005 250/282 |
| 2016/0027633 | A1 | 1/2016 | Jung et al. | |

FOREIGN PATENT DOCUMENTS

| | | | | |
|---|---|---|---|---|
| DE | 11 2012 005 395 | T5 | 9/2014 | |
| JP | 11-510946 | A | 9/1999 | |
| JP | 2008-500684 | A | 1/2008 | |
| JP | 2015-507820 | A | 3/2015 | |
| WO | WO 2010/023706 | A1 | 3/2010 | |
| WO | WO-2010023706 | A1 * | 3/2010 | H01J 49/022 |

OTHER PUBLICATIONS

Japanese-language Written Opinion (PCT/ISA/237) issued in PCT Application No. PCT/JP2016/083150 dated Feb. 7, 2017 (Four (4) pages).
Chinese-language Office Action issued in counterpart Chinese Application No. 201680072855.2 dated Apr. 25, 2019 (six (6) pages).
German-language Office Action issued in counterpart German Application No. 11 2016 005 070.4 dated Jul. 30, 2019 (seven (7) pages).

* cited by examiner (1) Conventional art (2) This example (1) Conventional art (2) Second example

MASS SPECTROMETER

TECHNICAL FIELD

The present invention relates to a mass spectrometry system including a quadrupole mass spectrometer and particularly relates to mass spectrometry that needs high sensitivity and high resolution in order to, for example, analyze an in-vivo sample.

BACKGROUND ART

Conventionally, in a mass spectrometry system in which a plurality of quadrupole electrode systems each of which includes at least four rod-like electrodes and in each of which a DC voltage U and a radio frequency (RF) voltage $V_{RF}$ cos ($\Omega t+\Phi_0$) are applied to the rod-like electrodes are connected in tandem, one of the plurality of quadrupole electrode systems is filled with a buffer gas and functions as a collision chamber that dissociates (collision induced dissociation) target ions with collision against the buffer gas. In particular, passing speed of ions passing through the quadrupole electrode system in the collision chamber is reduced by collision against the buffer gas, and therefore there is a high possibility that delay of the ions passing through the collision chamber has a bad influence such as crosstalk on a mass spectrum serving as a result of mass spectrometry. Thus, in order to accelerate decelerated ions, there is employed means for generating a potential gradient of a DC component in a direction of travel of the ions.

As illustrated in FIG. 5, in Patent Literature 1, as means for accelerating ions in a collision chamber, four rod-like electrodes (4-2-a, 4-2-b, 4-2-c, and 4-2-d) whose diameters are gradually changed are alternately disposed in opposite directions, and an RF voltage −V cos Ωt and a micro DC voltage ΔUy are superimposed and applied to the facing electrodes (4-2-a and 4-2-c) and an RF voltage +V cos Ωt and a micro DC voltage ΔUx are superimposed and applied to the other facing electrodes (4-2-b and 4-2-d). With this, a potential gradient of a DC component is generated on a central axis of the electrode system. A numerical analysis result of a potential of the DC component generated on the central axis at this time is illustrated in FIG. 6. It is found that the potential of the DC component is inclined in a direction of travel of ions (z direction). With this, ions passing through the inside are accelerated.

CITATION LIST

Patent Literature (s)

PTL 1: U.S. Pat. No. 5,847,386

SUMMARY OF INVENTION

Technical Problem(s)

In a case where the potential gradient of the DC component is generated as illustrated in FIG. 6, ions passing through the inside can be accelerated in a direction in which the ions travel. At this time, results of analyzing orbits and speed of a hundred ions passing through the inside are illustrated in FIG. 7. From the analysis results of the speed in the z direction, it is found that the speed remarkably oscillates. In a case of a normal electrode system in which four electrodes having the same electrode diameter are disposed in parallel to one another as illustrated in FIG. 8, although speed in the z direction is reduced due to collision against a buffer gas as illustrated in FIG. 9, the speed does not oscillate unlike FIG. 7. Results of plotting z-direction speed v, of each ion at an exit of the electrode system in a case of the system illustrated in FIG. 5 and in a case of the system illustrated in FIG. 8 are illustrated in FIG. 10. A dispersion width of $v_z$ in a case of the system illustrated in FIG. 5 is approximately five times as large as a dispersion width of $v_z$ in a case of the system illustrated in FIG. 8. This is closely related to a difference between passing times of ions, in other words, a width of a mass spectrum, and therefore there is a high possibility that this leads to reduction in resolution.

A result of studying a cause of speed dispersion that leads to reduction in resolution will be described below. It is considered that, although Z-direction speed of ions does not oscillate in the system of FIG. 8, Z-direction speed of ions oscillates in the system of FIG. 5 because a potential of an RF component, as well as the potential gradient of the DC component (FIG. 6), is inclined. An analysis result of the potential of the RF component on a central axis is illustrated in FIG. 11. The potential of the RF component is changed in accordance with a z coordinate, in other words, an RF electric field is generated also in the z direction, and therefore it is considered that ions oscillate in the z direction and speed of the ions oscillates and is dispersed also at the exit.

Solution to Problem(s)

In order to solve the above problems, a first mass spectrometer of the invention includes: 2n rod-like electrodes; and a control unit configured to apply a DC voltage U and a radio frequency voltage $V_{RF}$ cos Ωt to the rod-like electrodes to generate a high-frequency multipole electric field equal to or more than a quadrupole electric field between the rod-like electrodes, in which: a distance between at least a pair of facing rod-like electrodes of the rod-like electrodes at an entrance portion that ions enter is different from the distance at an exit portion from which ions are emitted; and the distance between the at least pair of the facing rod-like electrodes is gradually reduced from the entrance portion toward the exit portion.

Further, a second mass spectrometer of the invention includes: 2n rod-like electrodes; and a control unit configured to apply a DC voltage U and a radio frequency voltage $V_{RF}$ cos Ωt to the rod-like electrodes to generate a high-frequency multipole electric field equal to or more than a quadrupole electric field between the rod-like electrodes, in which: a distance between at least a pair of facing rod-like electrodes of the rod-like electrodes at an entrance portion that ions enter is different from the distance at an exit portion from which ions are emitted; and the distance between the at least pair of the facing rod-like electrodes is gradually increased from the entrance portion toward the exit portion.

Advantageous Effects of Invention

Generation of an RF electric field in a direction of travel of ions is restrained (ion oscillation in a z direction is restrained), and therefore it is possible to achieve both acceleration of decelerated ions and reduction in a speed dispersion width. With this, it is possible to achieve high-sensitivity and high-resolution analysis.

DESCRIPTION OF EMBODIMENTS

A potential distribution that restrains ions from oscillating in a z direction near an exit is generated. For this, the following two means are considered to be necessary. As first means, generation of an RF electric field in the z direction is restrained by maintaining a substantially constant potential of an RF component (a potential having a small change or a potential that is not changed) with respect to a z coordinate near the exit.

Figure 12:
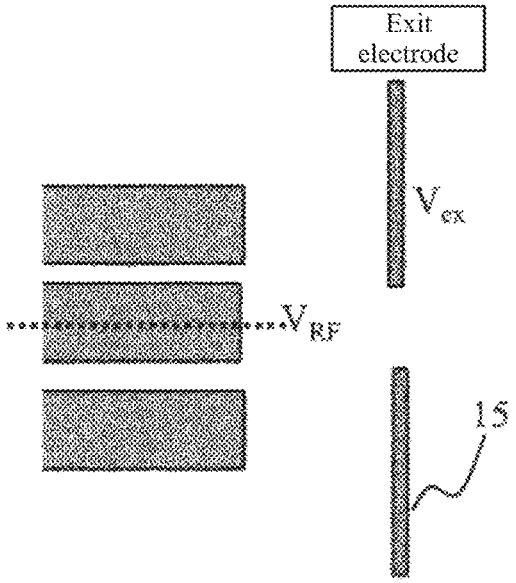
FIG. 12 is a schematic diagram illustrating a quadrupole electrode system and an exit electrode subsequent thereto.
Figure 13:
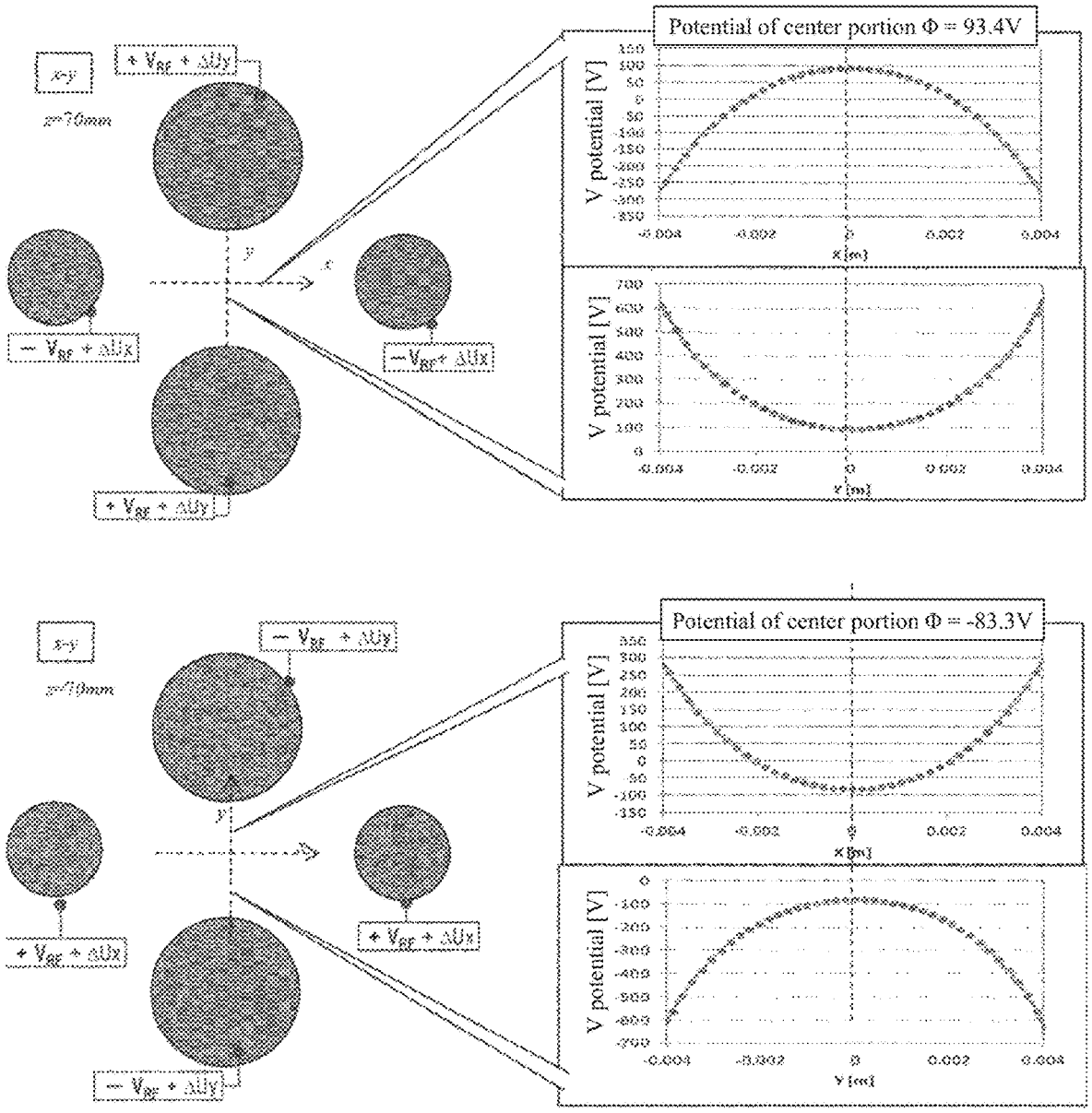
FIG. 13 illustrates a result of analysis of a potential on a central axis near an exit of a quadrupole system in an opposite phase.
Figure 20:
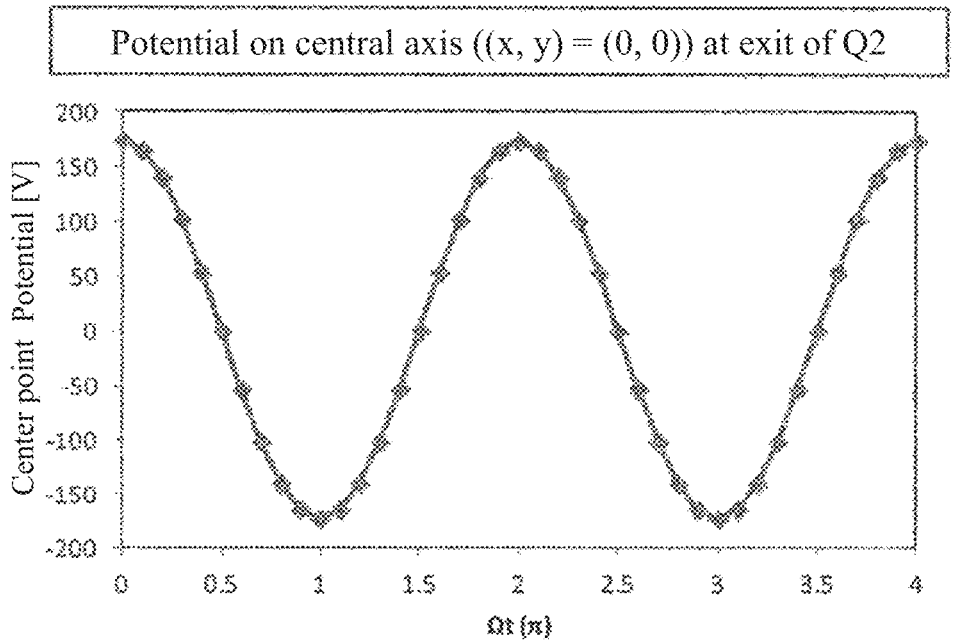
FIG. 20 are diagrams illustrating results of analysis of a time change in a potential on a central axis ((x, y)=(0, 0)) at a Q2 exit in the (conventional) system illustrated in FIG. 5 and the system (in the second example) illustrated in FIG. 14.
Figure 20:
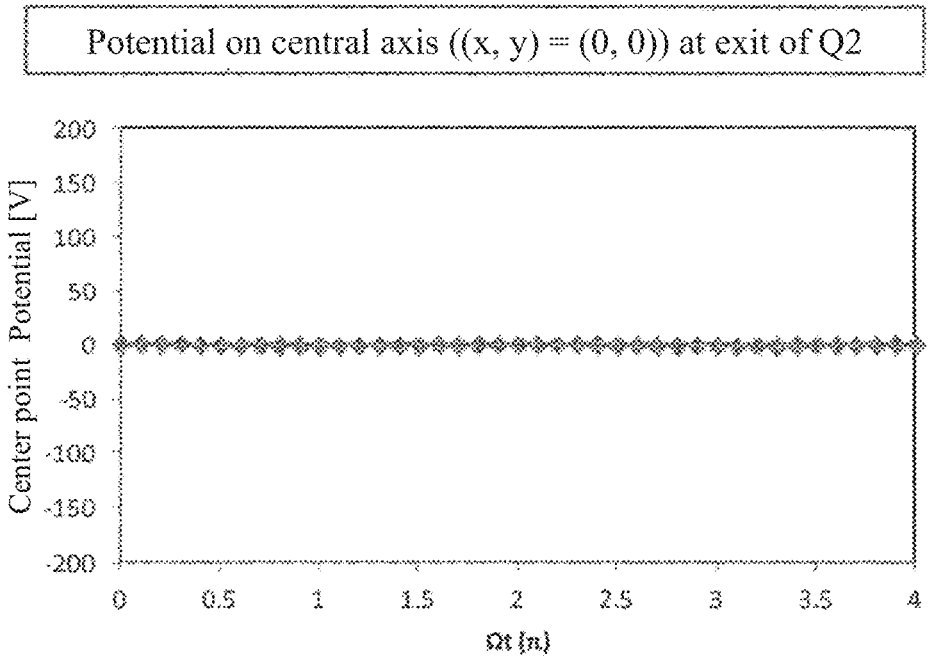

Further, in a case where the potential of the RF component on a central axis is not zero, as illustrated in FIG. 13, the potential on the central axis also oscillates between a positive value and a negative value depending on a phase. A result of analysis of a time change in the potential on the central axis at the exit at this time is illustrated in FIG. 20(1). In this case, it is found that the potential oscillates at a frequency the same as an RF voltage frequency with an amplitude of approximately 173 V. As illustrated in FIG. 12, only a voltage of a DC component is normally applied to an exit electrode and an RF voltage is not applied thereto, and therefore an RF electric field equivalent to the RF electric field generated on the central axis is generated between a multipole electrode system and the exit electrode. In other words, an RF electric field in which ions oscillate in the z direction is generated also between the multipole electrode system and the exit electrode. Thus, as second means, as illustrated in FIG. 20(2), the RF component of the potential on the central axis near the exit of the multipole electrode system is adjusted to become zero by a shape and disposition of the electrodes and a voltage.

As described above, in the multipole electrode system inside which an inclined DC potential is generated, the substantially constant potential of the RF component with respect to the z coordinate is maintained near the exit of the multipole electrode system, and the potential of the RF component on the central axis near the exit has a value close to zero. This restrains generation of an RF electric field in a direction of travel of ions (restrains ion oscillation in the z direction). Therefore, a mass spectrometer can achieve both acceleration of decelerated ions and reduction in a speed dispersion width and perform high-sensitivity and high-resolution analysis.

Hereinafter, examples of the invention will be described with reference to the drawings.

Figure 1:
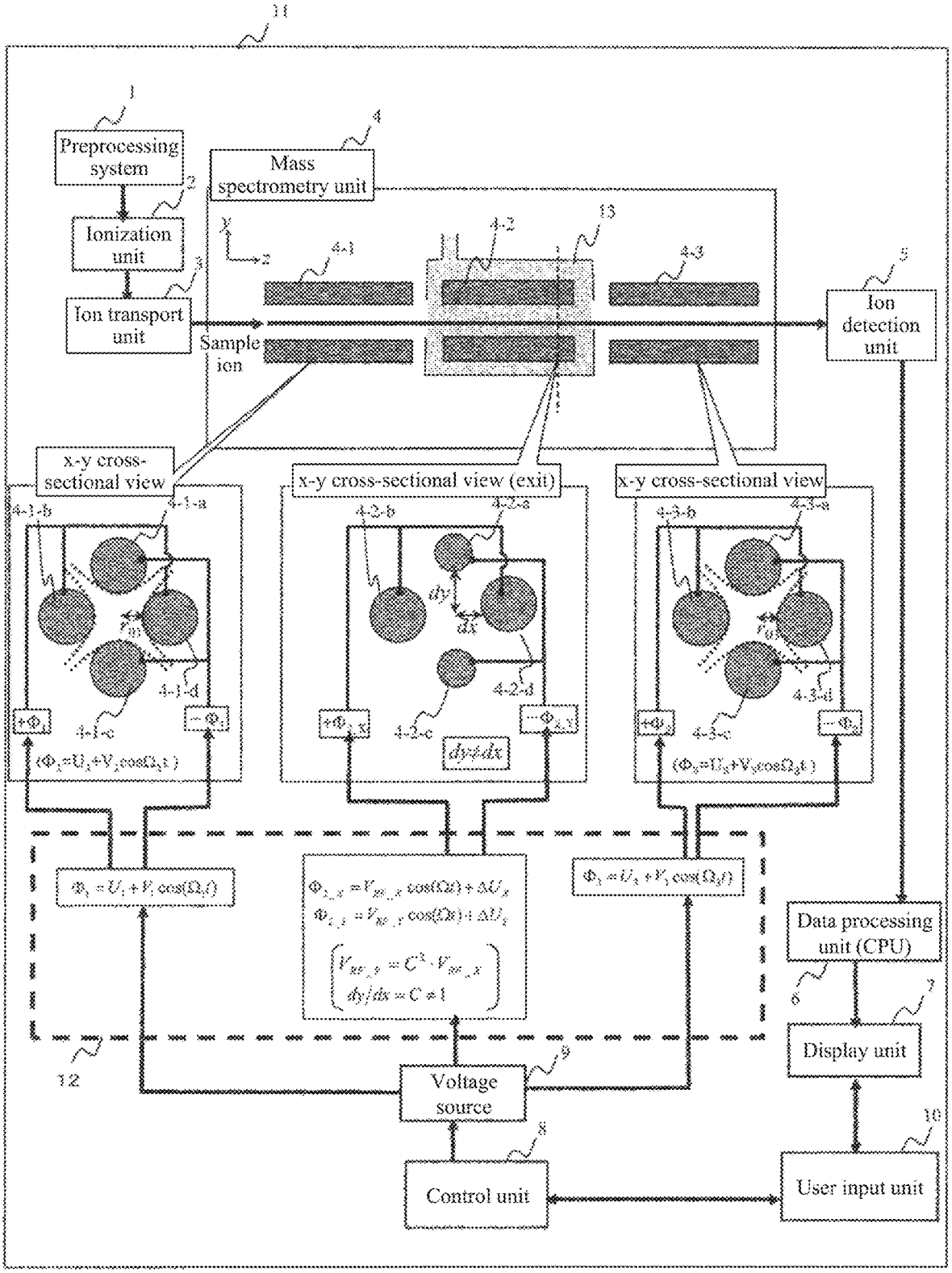
FIG. 1 is a schematic diagram illustrating disposition and a structure of each electrode in a tandem quadrupole mass spectrometer according to a first example of the invention.
Figure 2:
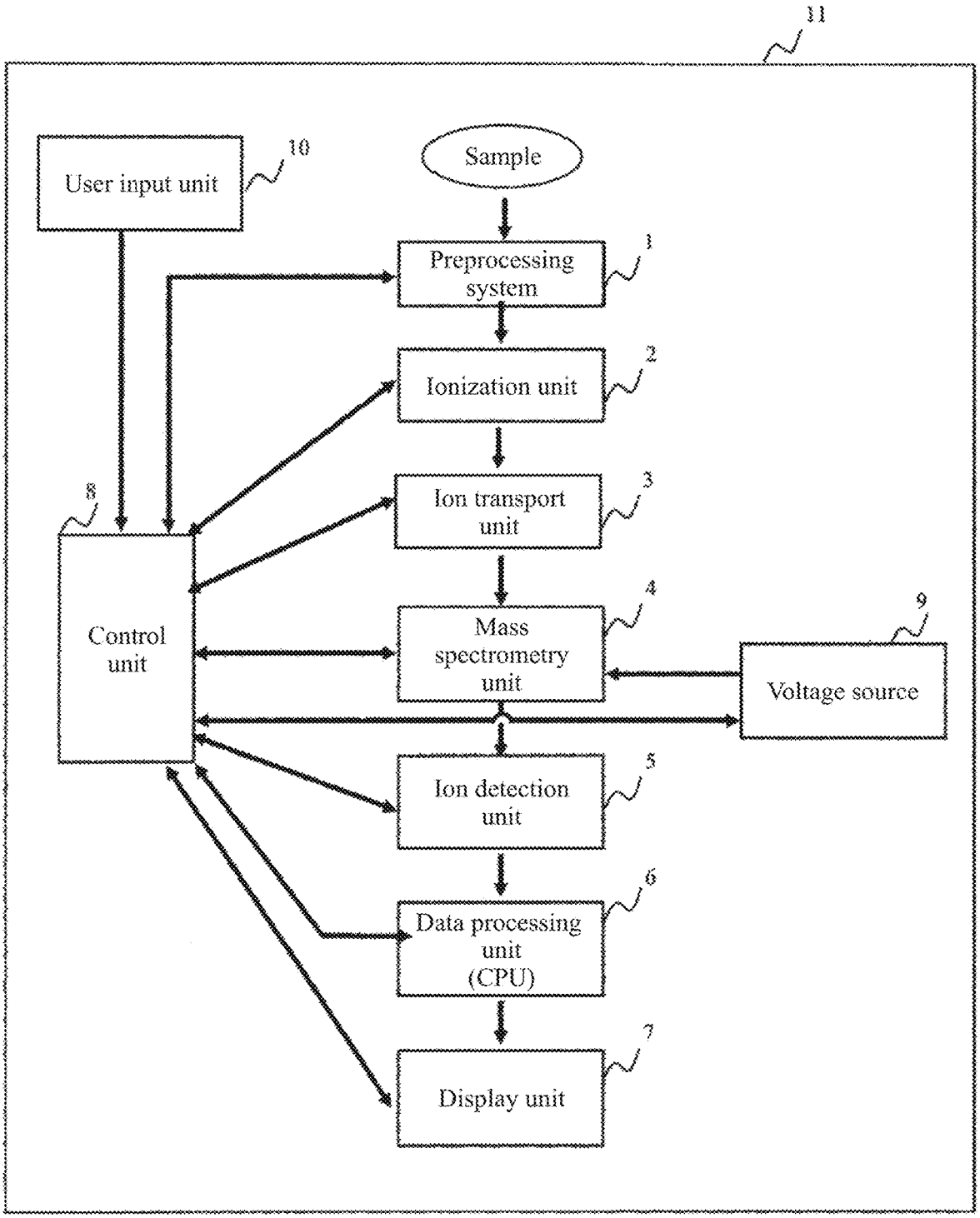
FIG. 2 is a schematic diagram illustrating the whole mass spectrometry system that measures mass spectrometry data according to the invention.

First, a first example will be described with reference to FIGS. 1 to 4, 6, and 11. FIG. 1 illustrates a tandem quadrupole mass spectrometer made up of three QMSs, which is a feature of the first example, and FIG. 2 is the whole configuration diagram of a mass spectrometry system in this example. First, an analysis flow of a mass spectrometry system 11 will be described. A sample serving as a target to be subjected to mass spectrometry is temporally separated/fractionated in a preprocessing system 1 such as gas chromatography (GC) or liquid chromatography (LC), and sample ions successively ionized in an ionization unit 2 pass through an ion transport unit 3. Then, the sample ions enter a mass spectrometry unit 4 and are subjected to mass separation. Herein, m denotes a mass of an ion, and Z denotes a charge valence number of an ion. A voltage to the mass spectrometry unit 4 is applied from a voltage source 9 while being controlled by a control unit 8. The separated and passed ions are finally detected in an ion detection unit 5 and data thereof is organized/processed in a data processing unit 6, and mass spectrometry data serving as an analysis result thereof is displayed on a display unit 7. The whole series of those mass spectrometry steps (ionization of a sample, transport and entering of sample ion beams to the mass spectrometry unit 4, a mass separation step, detection of ions, data processing, and instruction processing of a user input unit 10) is controlled by the control unit 8.

Herein, as illustrated in FIG. 1, the mass spectrometry unit 4 is configured so that three tiers of quadrupole mass spectrometers (QMSs), each of which is made up of four rod-like electrodes, are connected on substantially the same axis. Herein, a multipole mass spectrometer made up of four or more rod-like electrodes may be used. Further, as illustrated in FIG. 1, when a longitudinal direction of the rod-like electrodes is set as the z direction and a cross-sectional direction thereof is set as an x-y flat surface, the four rod-like electrodes may be cylindrical electrodes or may be rod-like electrodes having a bipolar surface shape as indicated by a dotted line, as illustrated in x-y cross-sectional views of the rod-like electrodes.

A voltage: $+(U_i+V_i \cos \Omega_i t)$ in which a DC voltage and a radio frequency voltage are superimposed is applied to a pair of facing electrodes 4-*i*-*a* and 4-*i*-*c* of the four electrodes of the i-th (i=1, 2, or 3) QMS in the mass spectrometry unit 4, and a voltage: $-(U_i+V_i \cos \Omega_i t)$ having an opposite phase thereto is applied to a pair of facing electrodes 4-*i*-*b* and 4-*i*-*d* thereof. Radio frequency electric fields $Ex_i$ and $Ey_i$ shown by the following expressions are generated among the four rod-like electrodes.

[Math. 1]

Math. 1

[数1]

$$E_{x_i} = -\frac{\partial \Phi_i}{\partial x} = -\frac{2(U_i + V_i \cos \Omega_i t)}{r_{0_i}^2} \cdot x. \quad (1)$$

$$E_{y_i} = -\frac{\partial \Phi_i}{\partial y} = -\frac{2(U_i + V_i \cos \Omega_i t)}{r_{0_i}^2} \cdot y$$

Herein, i denotes the number (first, second, . . . ) tiers of the QMS and satisfies i=1, 2, and 3 herein. Ionized sample ions are introduced along a central axis (z direction) among those rod-like electrodes and pass through the radio frequency electric fields shown by an expression (1). Stability of an ion orbit in x and y directions at this time is determined on the basis of the following dimensionless parameters $a_i$ and $q_i$ derived from an equation of motion (Mathieu equation) of the ions among the rod-like electrodes.

[Math. 2]

Math. 2

$$a_i = \frac{8eZU_i}{\Omega_i^2 m r_{0_i}^2} \quad (9)$$

$$q_i = \frac{4eZV_i}{\Omega_i^2 m r_{0_i}^2} \quad (10)$$

Herein, the dimensionless parameters $a_i$ and $q_i$ are stability parameters in the i-th QMS.

Further, in the expressions (9) and (10), $r_0$ denotes a half value of a distance between facing rod electrodes, e denotes an elementary charge, m/Z denotes a mass-to-charge ratio of an ion, U denotes a DC voltage applied to the rod electrodes, and V and Ω denote an amplitude and an angular oscillation frequency of a radio frequency voltage. When values of $r_0$, U, V, and Ω are determined, ion species correspond to different ($a_i$, $q_i$) points, respectively, on an a-q flat surface of FIG. 3 in accordance with the mass-to-charge ratios m/Z thereof. At this time, all the different ($a_i$, $q_i$) points of the respective ion species exist on a straight line shown by the following expression (11) on the basis of the expressions (9) and (10)

[Math. 3]

Math. 3

$$a_i = \frac{2U_i}{V_i} q_i \quad (11)$$

Figure 3:
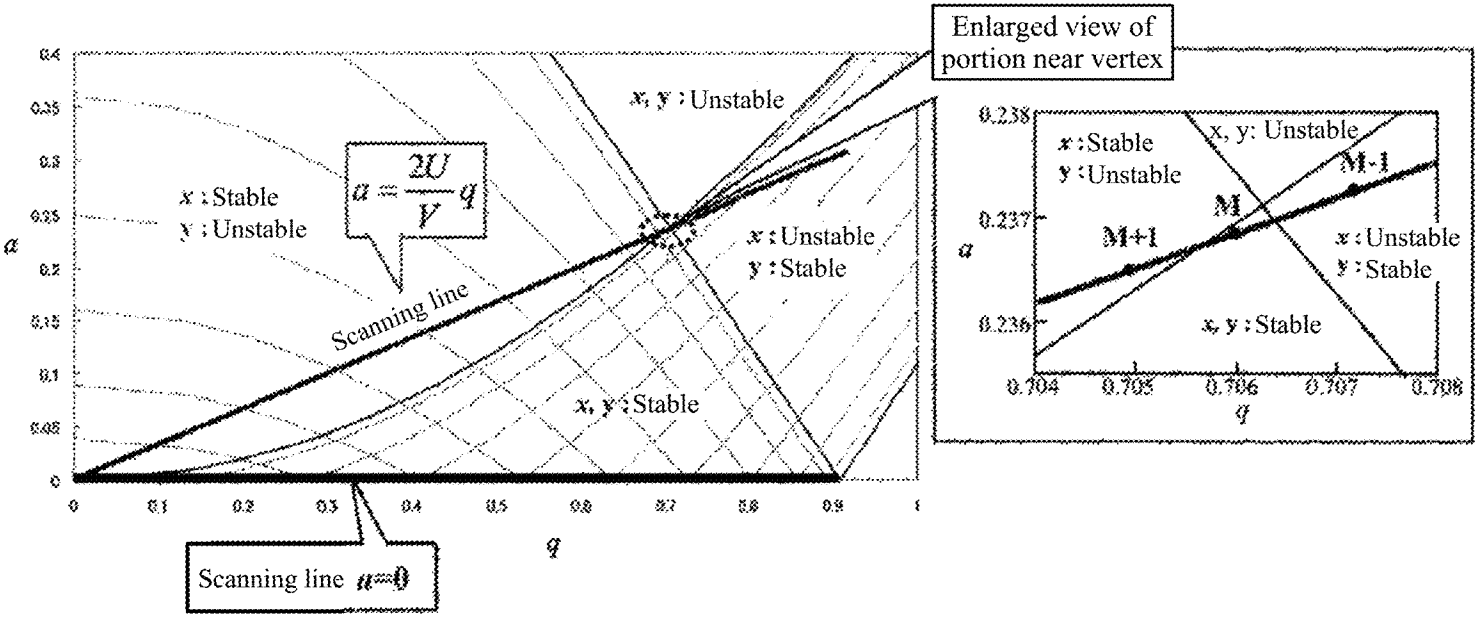
FIG. 3 is an ion stable transmissive area diagram in a quadrupole electric field.

A quantitative range (stable transmissive area) of $a_i$ and $q_i$ that give a stable solution to the ion orbit in both the x and y directions is illustrated in FIG. 3. In order to perform mass separation by causing only ion species having a specified mass-to-charge ratio m/Z to pass through the rod-like electrodes and unstably emitting the other ion species to the outside of the QMS, it is necessary to adjust a U-to-V ratio so as to intersect near a vertex of the stable transmissive area in FIG. 3 (FIG. 3). Stably transmitted ions pass through the rod-like electrodes in the z direction while oscillating, whereas unstable ions are emitted in the x and y directions while oscillation of the unstable ions is being diverged. By using this point, the tandem quadrupole mass spectrometry system including three QMSs is configured as follows: in the first QMS (Q1), an application voltage to the electrodes is adjusted so that an operation point exists near the vertex of the stable transmissive area as illustrated in FIG. 3 in order to cause only ion species having a specified mass-to-charge ratio m/Z to pass through Q1; in the second QMS (Q2), a collision chamber 13 with which a buffer gas such as a neutral gas is filled is provided, and specified ion species (parent ions) that have passed through Q1 are destroyed therein by collision induced dissociation or the like to generate fragment ions (daughter ions); and, in the third QMS (Q3), the various kinds of daughter ions are subjected to mass spectrum analysis.

Figure 4:
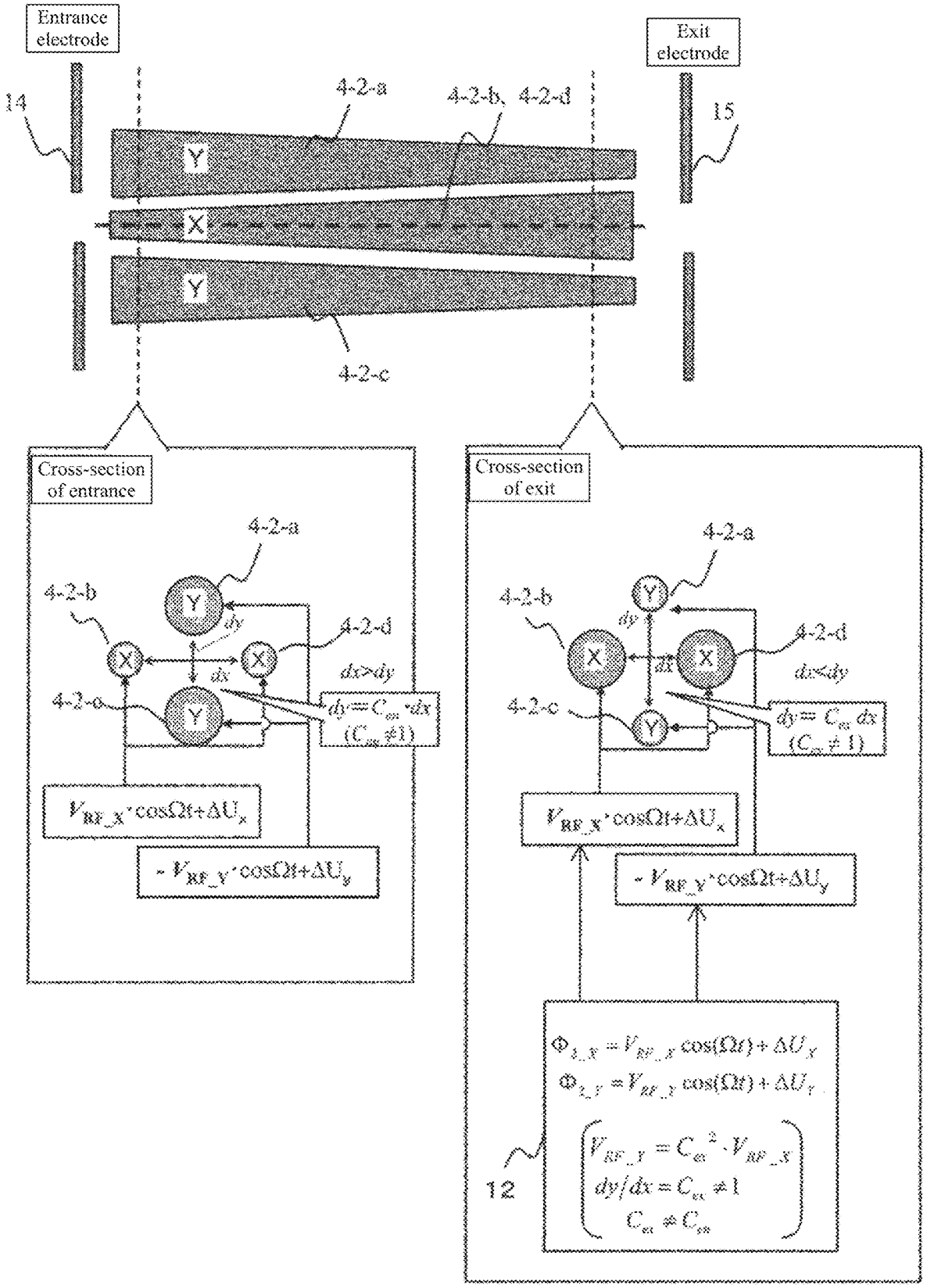
FIG. 4 is a schematic diagram illustrating a structure of a quadrupole electrode system and a voltage application method according to the first example of the invention.
Figure 6:
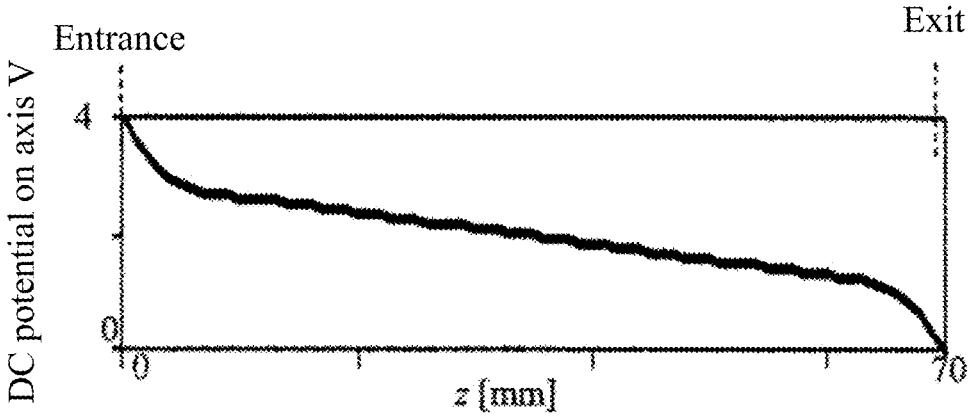
FIG. 6 is a diagram showing a summarized result of deriving potentials of DC components on a central axis in the systems of FIG. 4 and FIG. 5 by simulation.
Figure 7:
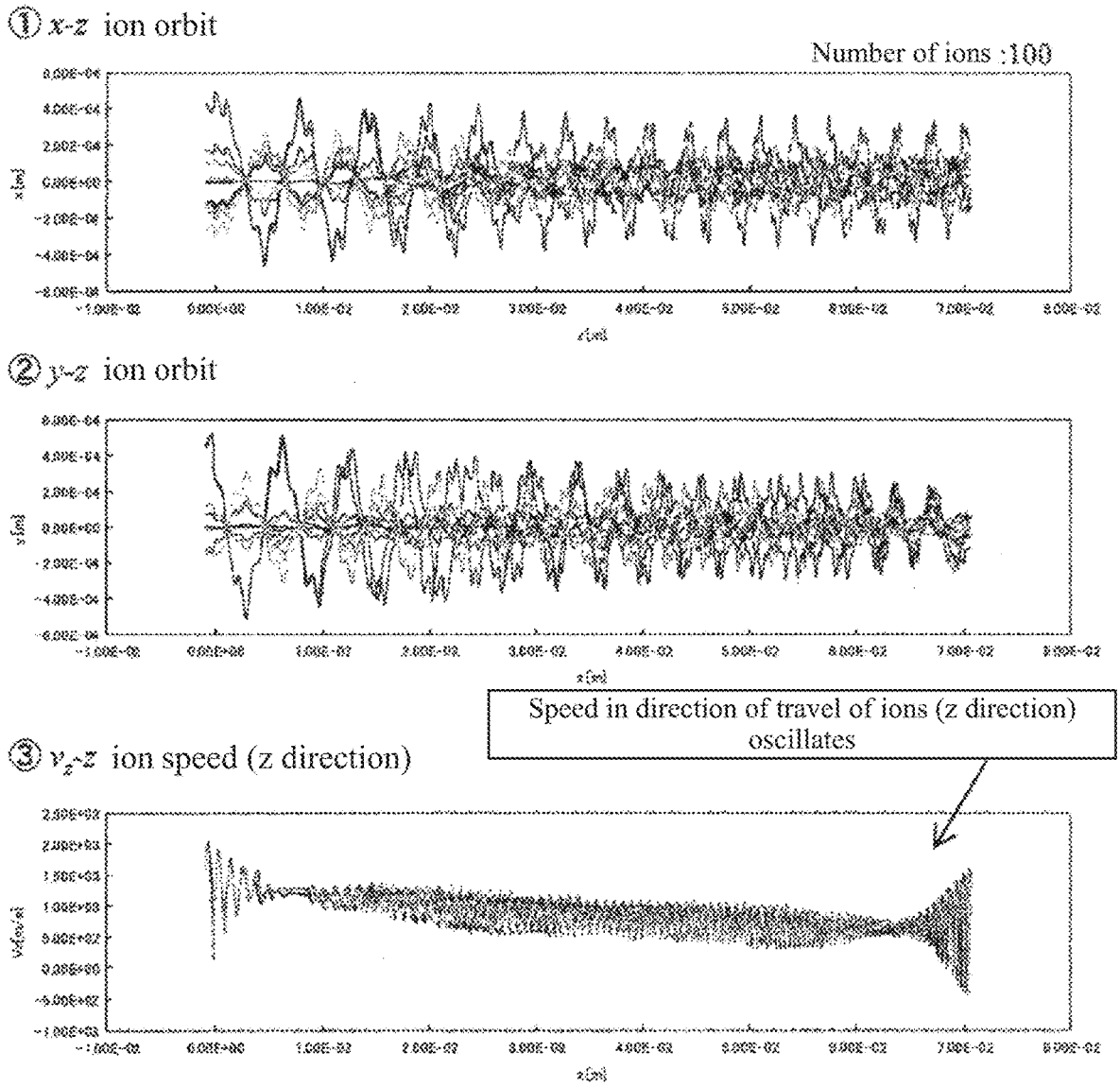
FIG. 7 illustrates a result of analysis of an ion orbit and z-direction speed in a quadrupole electrode by a conventional method.
Figure 8:
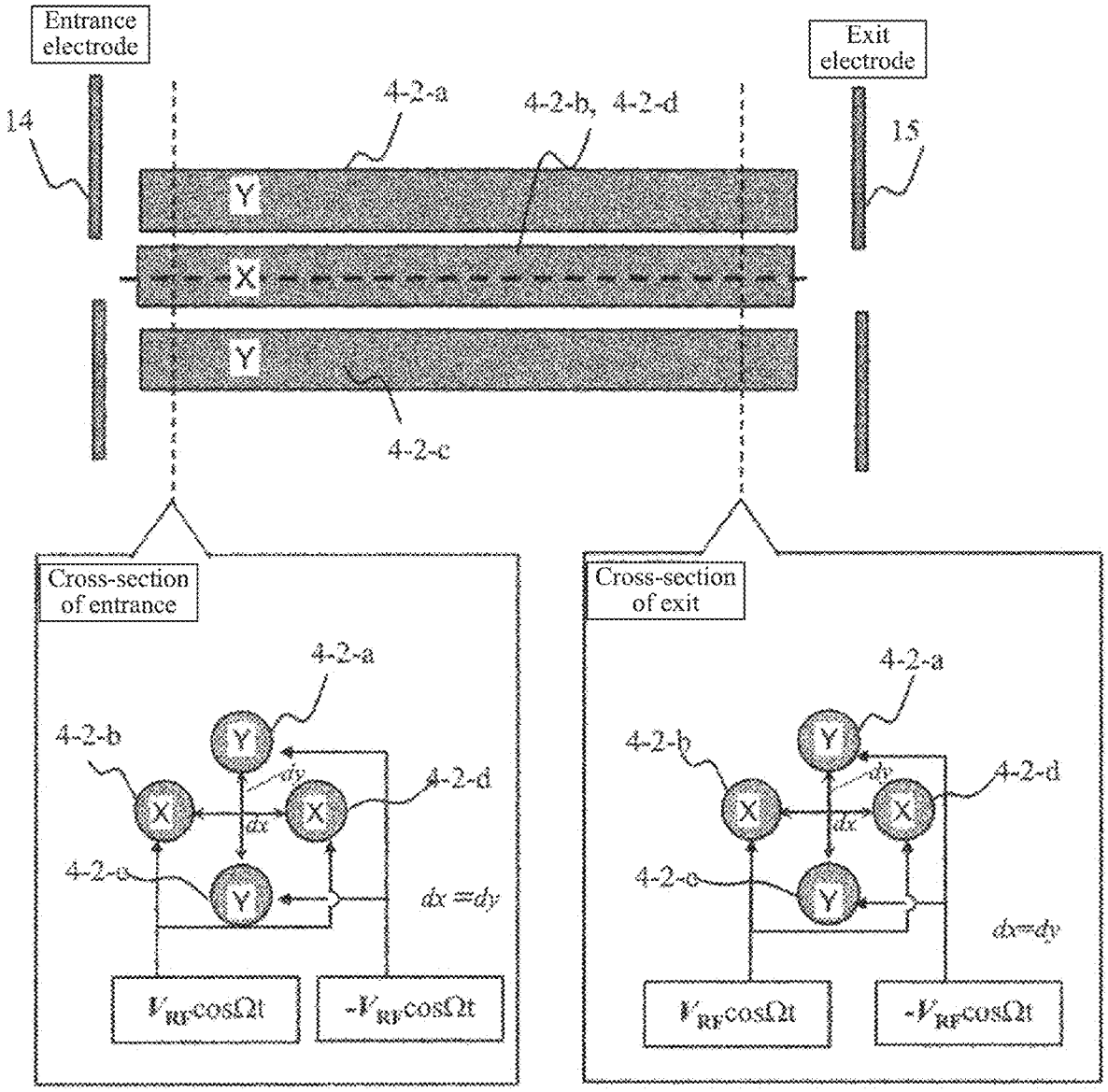
FIG. 8 is a schematic diagram illustrating a structure of a conventional quadrupole electrode system in which a distance between facing electrodes is not changed in accordance with a z coordinate and a conventional voltage application method.
Figure 9:
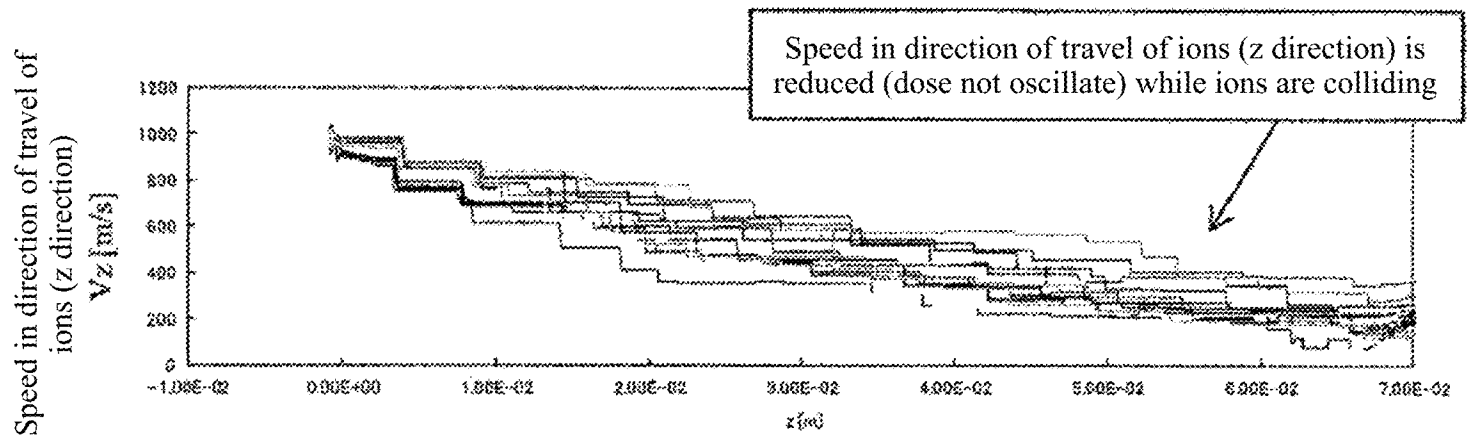
FIG. 9 illustrates a result of analysis of z-direction speed of ions in a quadrupole electrode system in the system illustrated in FIG. 8.
Figure 11:
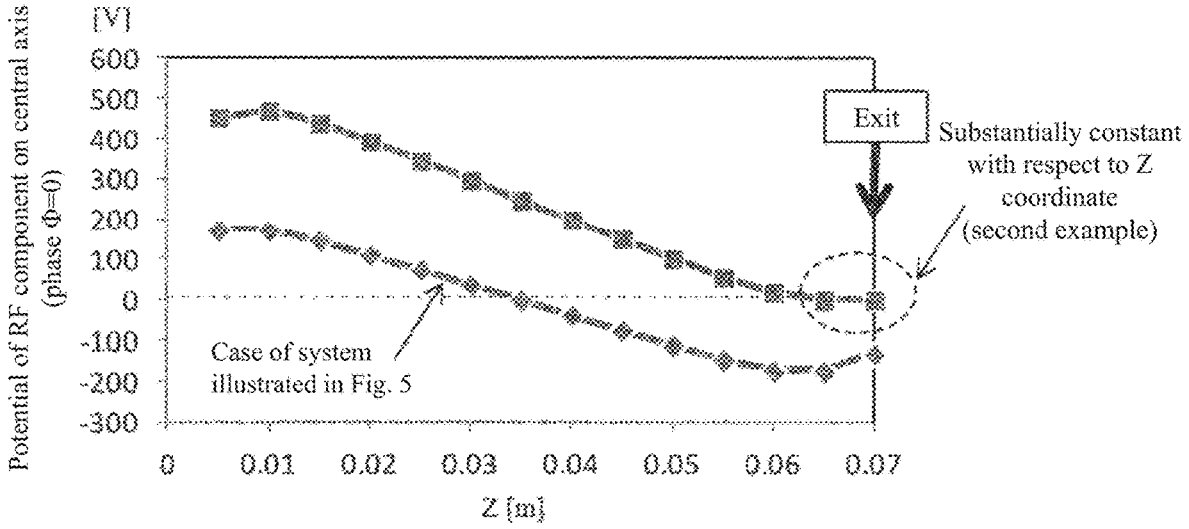
FIG. 11 illustrates results of obtaining z-coordinate dependency of a potential of an RF component on a central axis in the (conventional) system illustrated in FIG. 5 and the system (in the second example) illustrated in FIG. 14.

In this example, as illustrated in FIG. 4, four rod-like electrodes (4-2-*a*, 4-2-*b*, 4-2-*c*, and 4-2-*d*) whose diameters are gradually changed are alternately disposed in opposite directions in an electrode system of the second QMS, and an RF voltage $-V_{RF_Y}/\cos \Omega t$ and a micro DC voltage ΔUy are superimposed and applied to the facing electrodes (4-2-*a* and 4-2-*c*) and an RF voltage $+V_{RF_X}/\cos \Omega t$ and a micro DC voltage ΔUx are superimposed and applied to the other facing electrodes (4-2-*b* and 4-2-*d*). With this, a potential gradient of a DC component is generated on a central axis of the electrode system. A numerical analysis result of the potential of the DC component generated on the central axis at this time is illustrated in FIG. 6. It is found that a potential of the DC component is inclined in a direction of travel of ions (z direction). With this, ions passing through the inside are accelerated. A potential of an RF component, as well as the potential of the DC component, is inclined (FIG. 11).

In this example, in order to generate a potential distribution that restrains ions from oscillating in the z direction near an exit of the electrode system of the second QMS, a voltage is adjusted so that the RF component of the potential on the central axis near the exit of the electrode system of the second QMS becomes zero. Specifically, as illustrated in FIG. 4, in a case where, based on a relationship between a distance dx between a pair X of the facing electrodes (4-2-*b* and 4-2-*d*) and a distance dy between a pair Y of the facing electrodes (4-2-*a* and 4-2-*c*), the relationship between the distances dx and dy at an entrance of the electrode system of the second QMS and the relationship at the exit thereof are shown by the following expressions,

[Math. 4]

Math. 4

$$\text{Entrance: } \frac{dy}{dx} = C_{en} \quad (1)$$

$$\text{Exit: } \frac{dy}{dx} = C_{ex} \quad (2)$$

$$\text{where } C_{en} \neq C_{ex}$$

Amplitude values $V_{RF_X}$ and $V_{RF_Y}$ of RF voltages applied to the pairs X and Y of the facing electrodes (4-2-*b* and 4-2-*d*) and (4-2-*a* and 4-2-*c*) are set in control content 12 on the basis of a relationship between the expressions (2) and (3).

[Math. 5]

Math. 5

$$V_{RF_Y}=C_{ex}^{2}\cdot V_{RF_X} \quad (3)$$

$$V_{RF_Y}\propto C_{ex}^{2}\cdot V_{RF_X} \quad (4)$$

Note that, at this time, the amplitude values may be set on the basis of a proportion shown by the expression (4), instead of the expression (3). At this time, the RF component of the potential on the central axis near the exit of the electrode system of the second QMS becomes zero, and therefore oscillation in the direction of travel of ions is restrained near the exit and the speed dispersion width is reduced.

According to this example, it is considered that, only by adjusting an application voltage to Q2, oscillation in the direction of travel of ions is restrained near the exit and the speed dispersion width is reduced while the potential gradient of the DC component (ion acceleration effect) is being maintained and high-resolution analysis can be expected.

Figure 14:
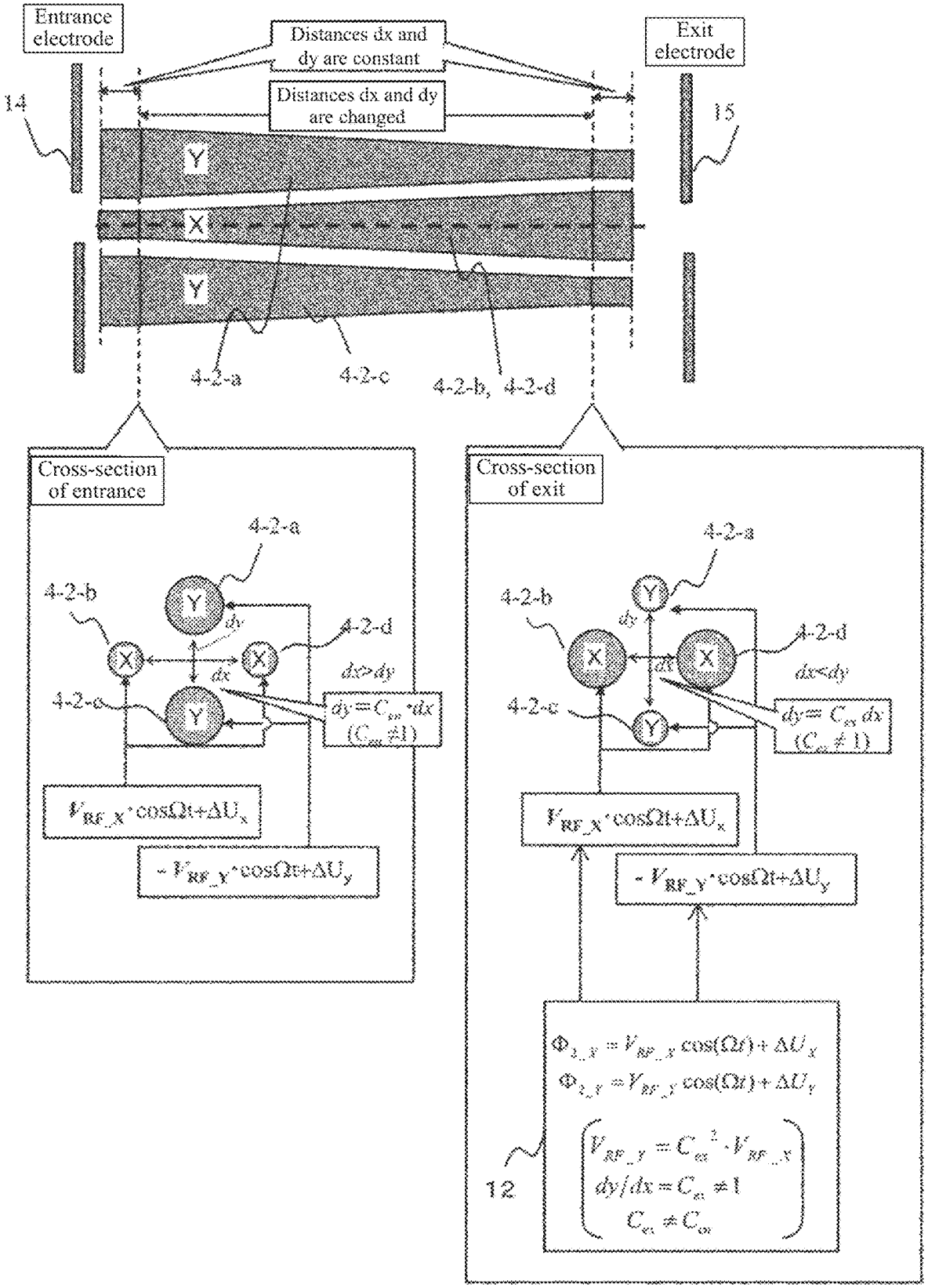
FIG. 14 is a schematic diagram illustrating a structure of a quadrupole electrode system and a voltage application method according to the first example of the invention.

Next, a second example will be described with reference to FIGS. 11, 12, 14, 15, and 20. Herein, as illustrated in FIG. 14, both ends or at least exit sides of the rod-like electrodes 4-2-*a*, 4-2-*b*, 4-2-*c*, and 4-2-*d* of Q2 are in parallel to the z direction (constant distances dx and dy between the facing electrodes are maintained with respect to the z coordinate). In other words, with this, generation of an RF electric field in the z direction is restrained by maintaining a substantially constant potential of the RF component (potential having a small change or potential that is not changed) with respect to the z coordinate near the exit. This parallel distance can be, for example, a distance that is 1/100 or more but less than 2/3 of the whole length of the rod-like electrodes from an exit portion.

Figure 5:
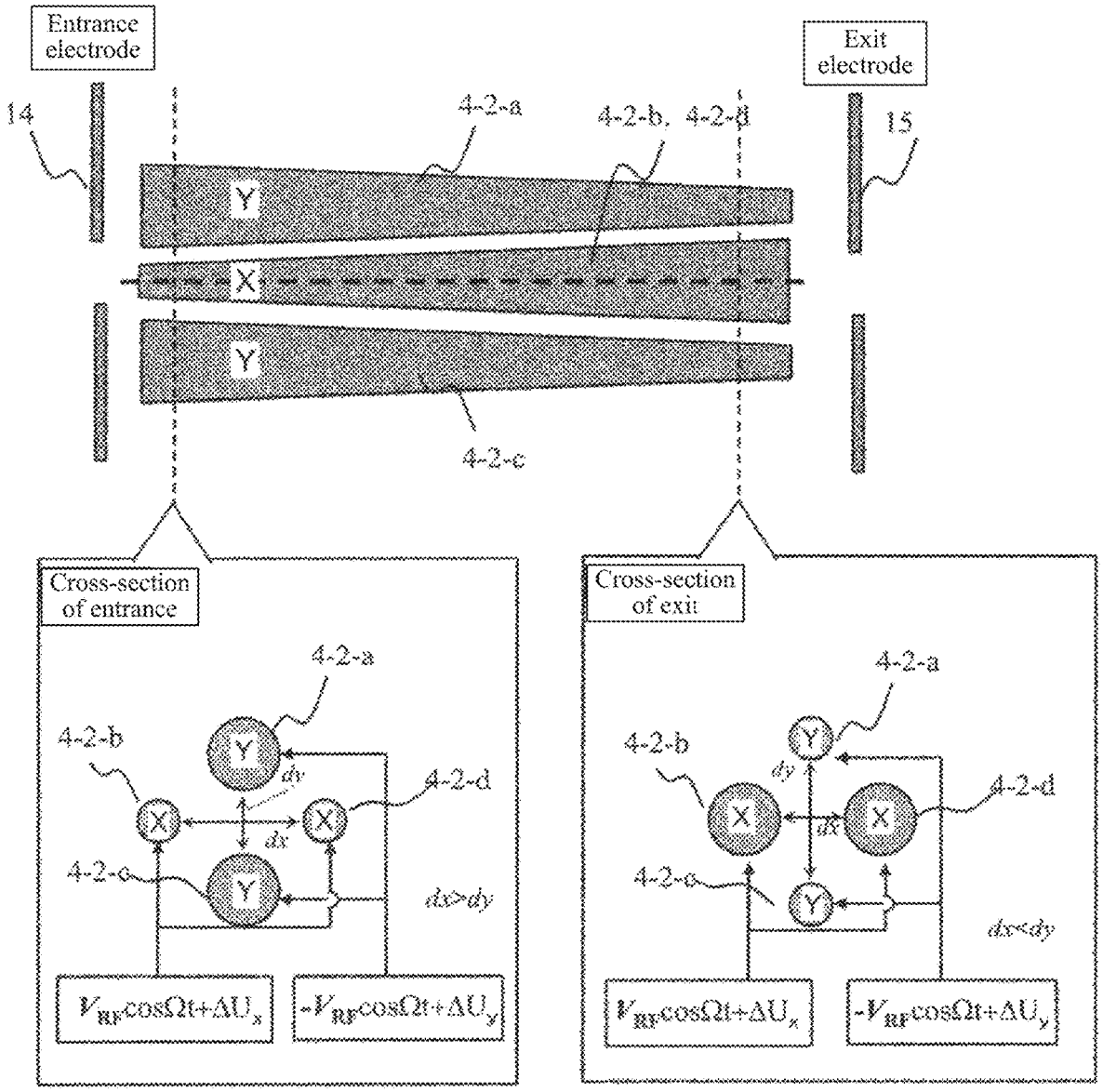
FIG. 5 is a schematic diagram illustrating a structure of a conventional quadrupole electrode system in which a distance between facing electrodes is changed in accordance with a z coordinate and a conventional voltage application method.
Figure 10:
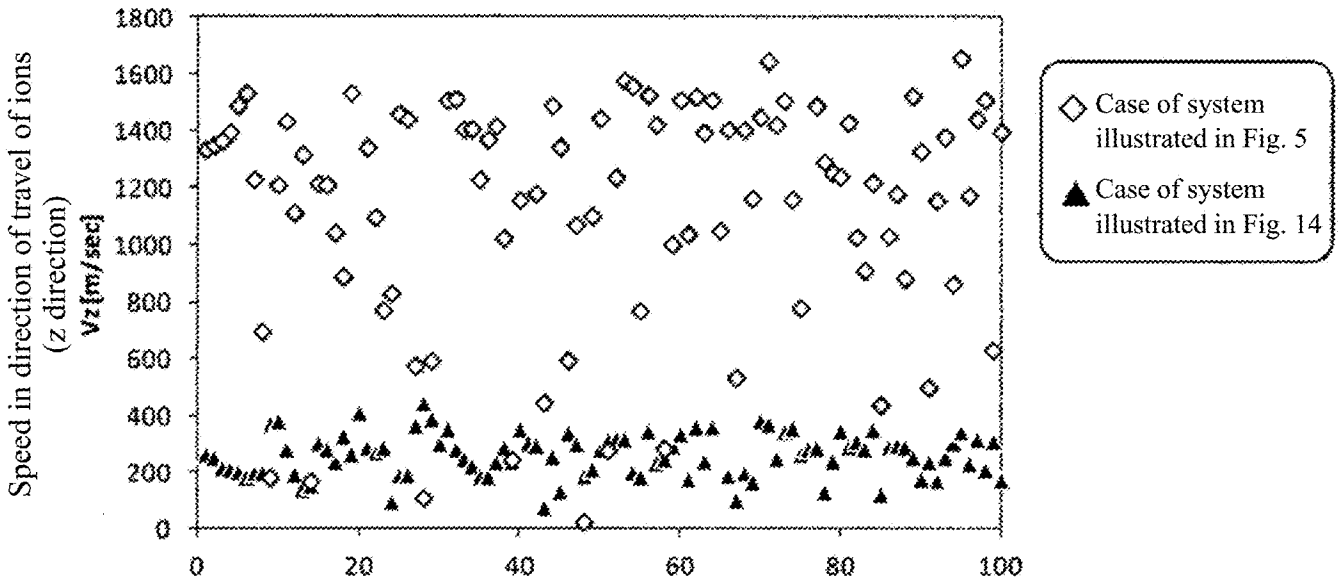
FIG. 10 illustrates results of analysis of z-direction speed at an exit in the (conventional) system illustrated in FIG. 5 and a system (in a second example) illustrated in FIG. 14.
Figure 15:
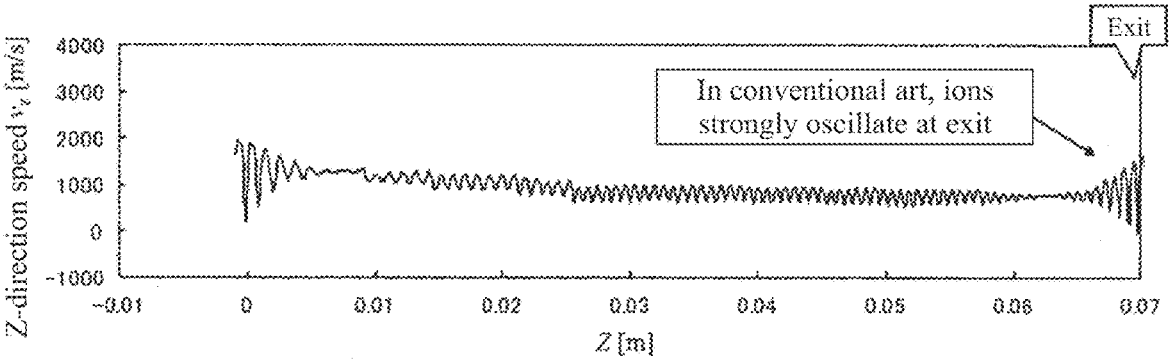
FIG. 15 illustrate results of analysis of z-direction ion speed in the (conventional) system illustrated in FIG. 5 and the system (in the second example) illustrated in FIG. 14.
Figure 15:
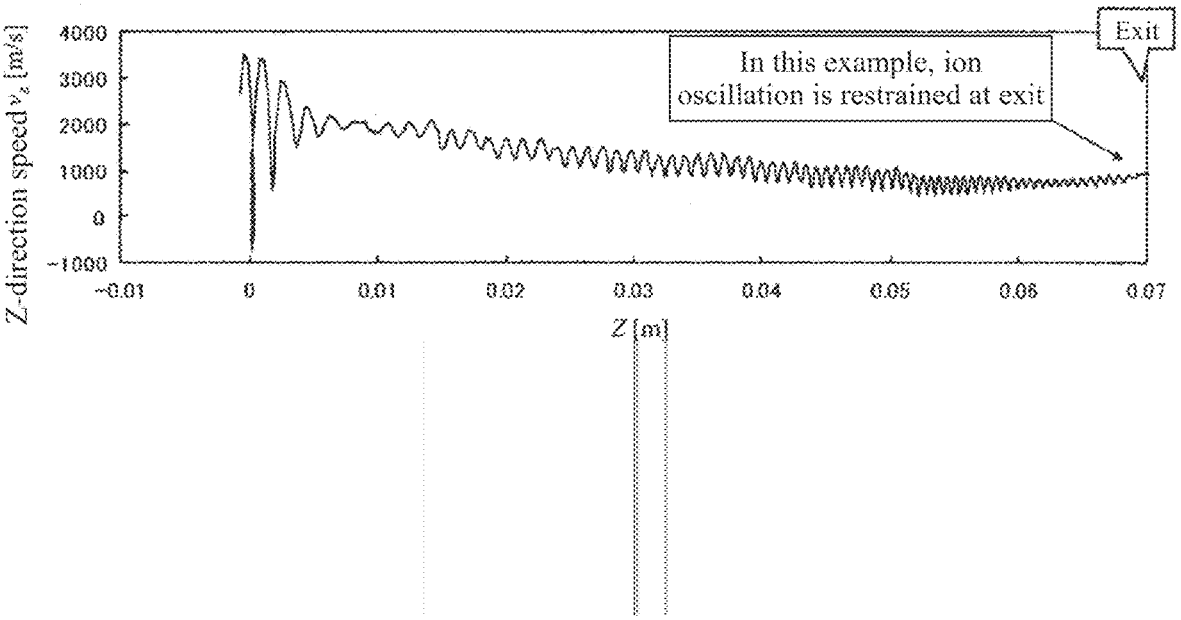

Effects of the second example are illustrated in FIGS. 10 and 11. FIG. 11 illustrates the potential of the RF component. The potential of the RF component is constant with respect to z near the exit. Further, at this time, amplitude values of RF voltages are adjusted by using the expressions (2) and (3) shown in the first example, and therefore, as illustrated in FIG. 20(2), the potential of the RF component is zero at the exit. A result of analysis of an actual speed distribution obtained in a case of K is illustrated in FIG. 10. It can be found that a dispersion width of z-direction speed is reduced to be approximately 1/5, as compared to white plots. FIGS. 15(1) and 15(2) illustrate results of analysis of z-direction ion speed inside Q2 in the conventional electrode system of FIG. 5 and the electrode system of this example. It can be found that the z-direction speed of ions strongly oscillates toward the exit of Q2 in FIG. 15(1), whereas the z-direction speed of ions is restrained toward the exit in FIG. 15(2).

As described above, according to this example, it is possible to further expect the effect of restraining oscillation in the direction of travel of ions near the exit and the effect of reducing the speed dispersion width.

Figure 16:
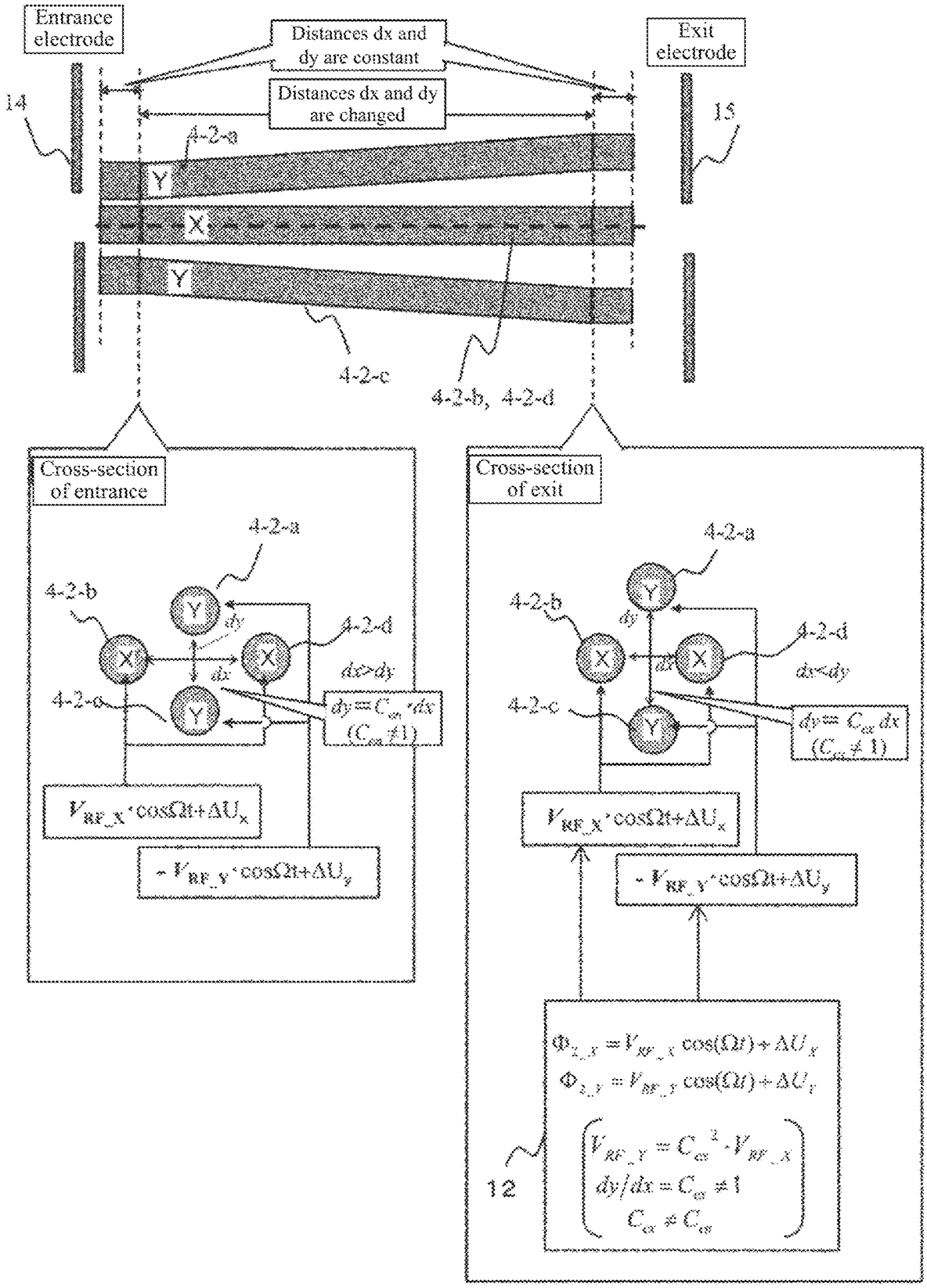
FIG. 16 is a schematic diagram illustrating a structure of a quadrupole electrode system and a voltage application method according to a third example of the invention.
Figure 17:
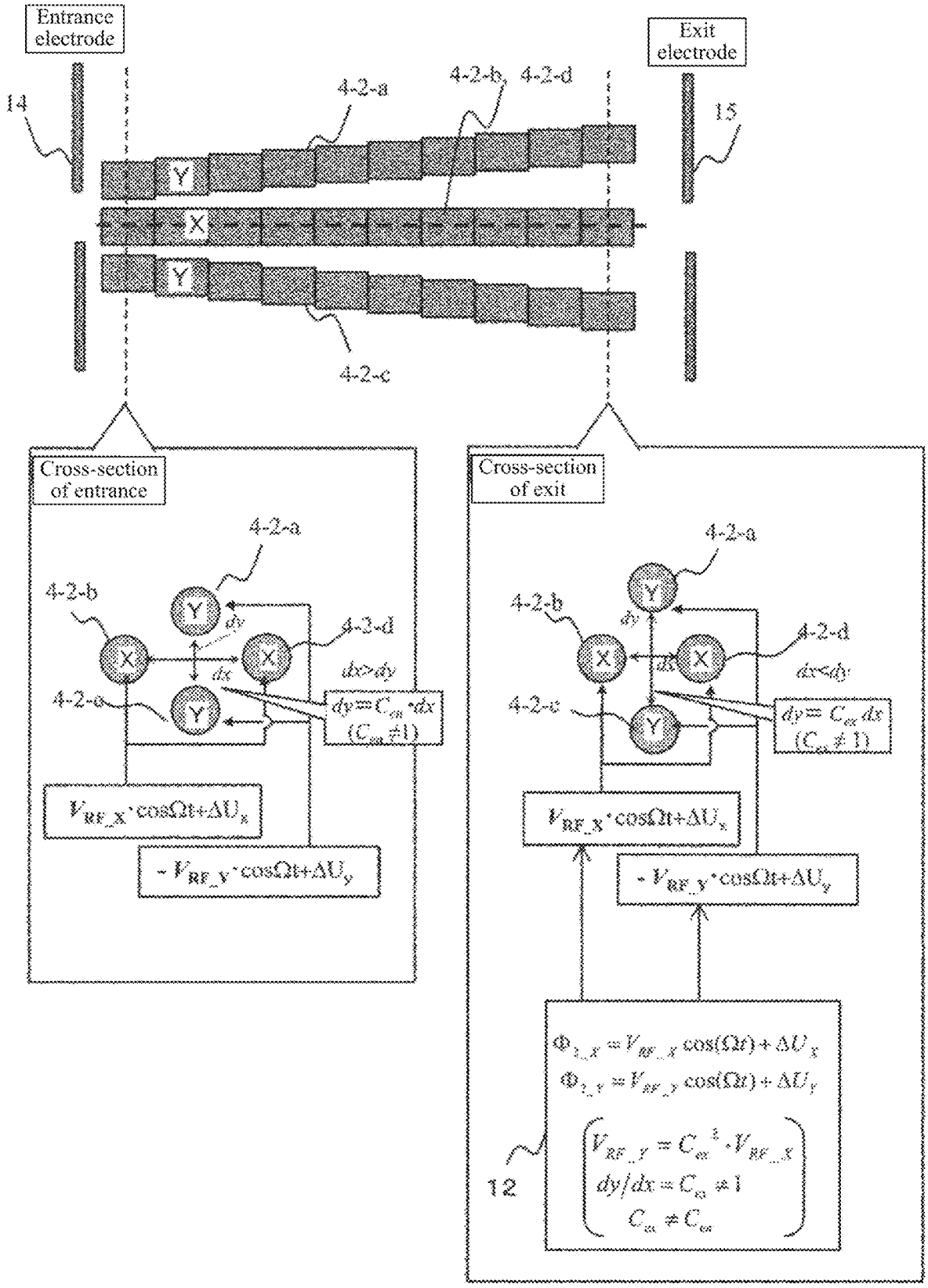
FIG. 17 is a schematic diagram illustrating a structure of a quadrupole electrode system and a voltage application method according to the third example of the invention.
Figure 18:
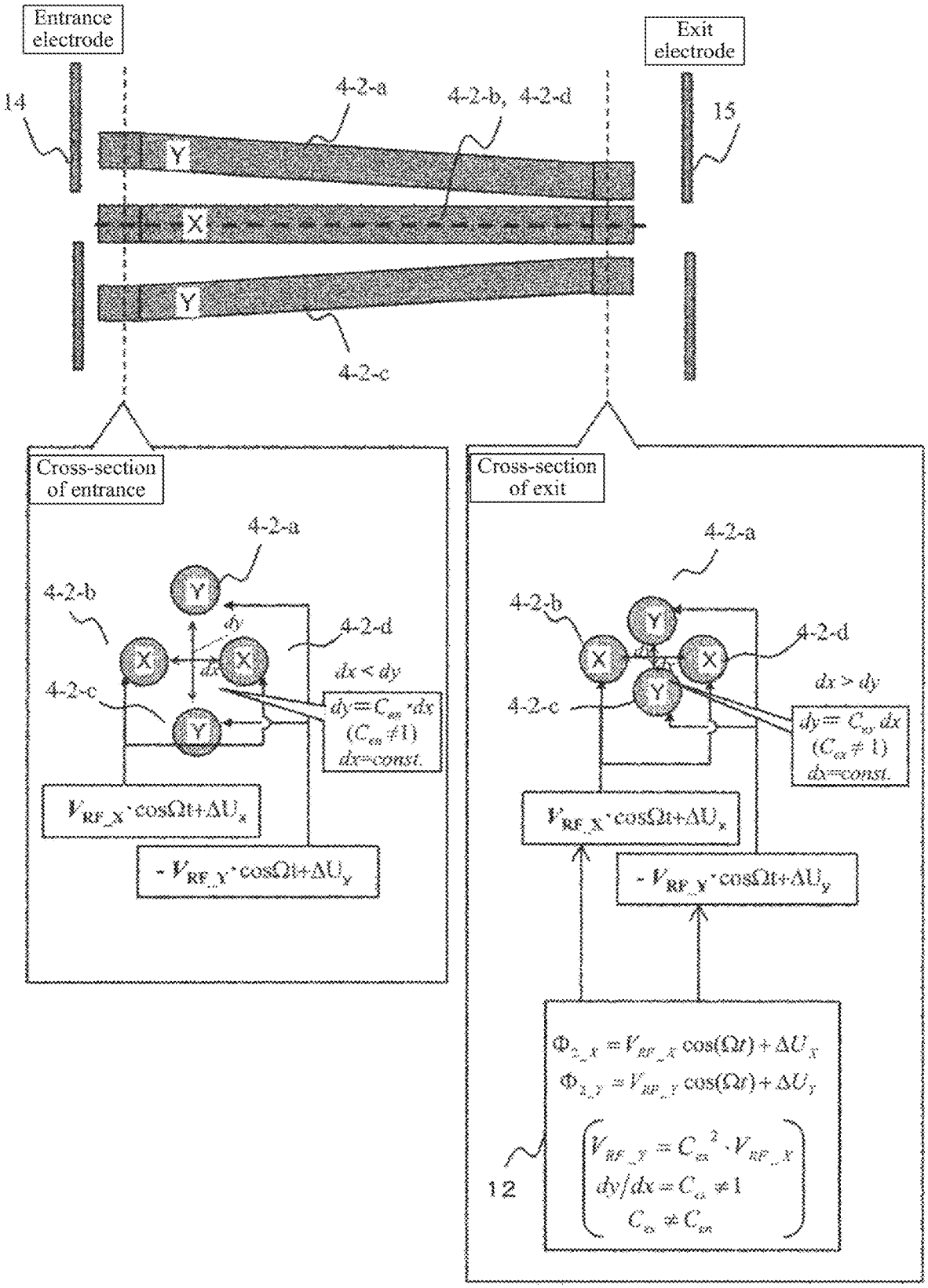
FIG. 18 is a schematic diagram illustrating a structure of a quadrupole electrode system and a voltage application method according to the third example of the invention.

Next, a third example will be described with reference to FIGS. 16, 17, and 18. Herein, as means for changing a distance between facing electrodes in accordance with the z coordinate, the rod-like electrodes 4-2-*a*, 4-2-*b*, 4-2-*c*, and 4-2-*d* of Q2 may not only be the electrodes having the electrode shape illustrated in FIG. 4 but also be an electrode system in which cylinder electrodes themselves are obliquely disposed without greatly changing diameters of the cylinder electrodes as illustrated in FIG. 16. Further, as illustrated in FIG. 17, a system may be such that a plurality of sets of short parallel telegraph-pole type electrodes obtained by dividing an electrode length of the whole Q2 into a plurality of (two or more) parts are prepared and distances between the electrodes are gradually changed in a stepwise manner while the distances between the electrodes are being gradually shifted. Further, as illustrated in FIG. 18, one of two pairs of the facing electrodes is provided in parallel, and a distance between the other pair of the electrodes is changed in accordance with the z coordinate. In other words, the distance dx between the pair X of the facing electrodes in FIG. 18 is constant, and the distance dy between the pair Y of the facing electrodes therein is changed in accordance with the z coordinate.

According to this example, simpler electrodes are used, and therefore it is considered that effects such as improvement in accuracy in manufacturing and cost reduction can be expected.

Figure 19:
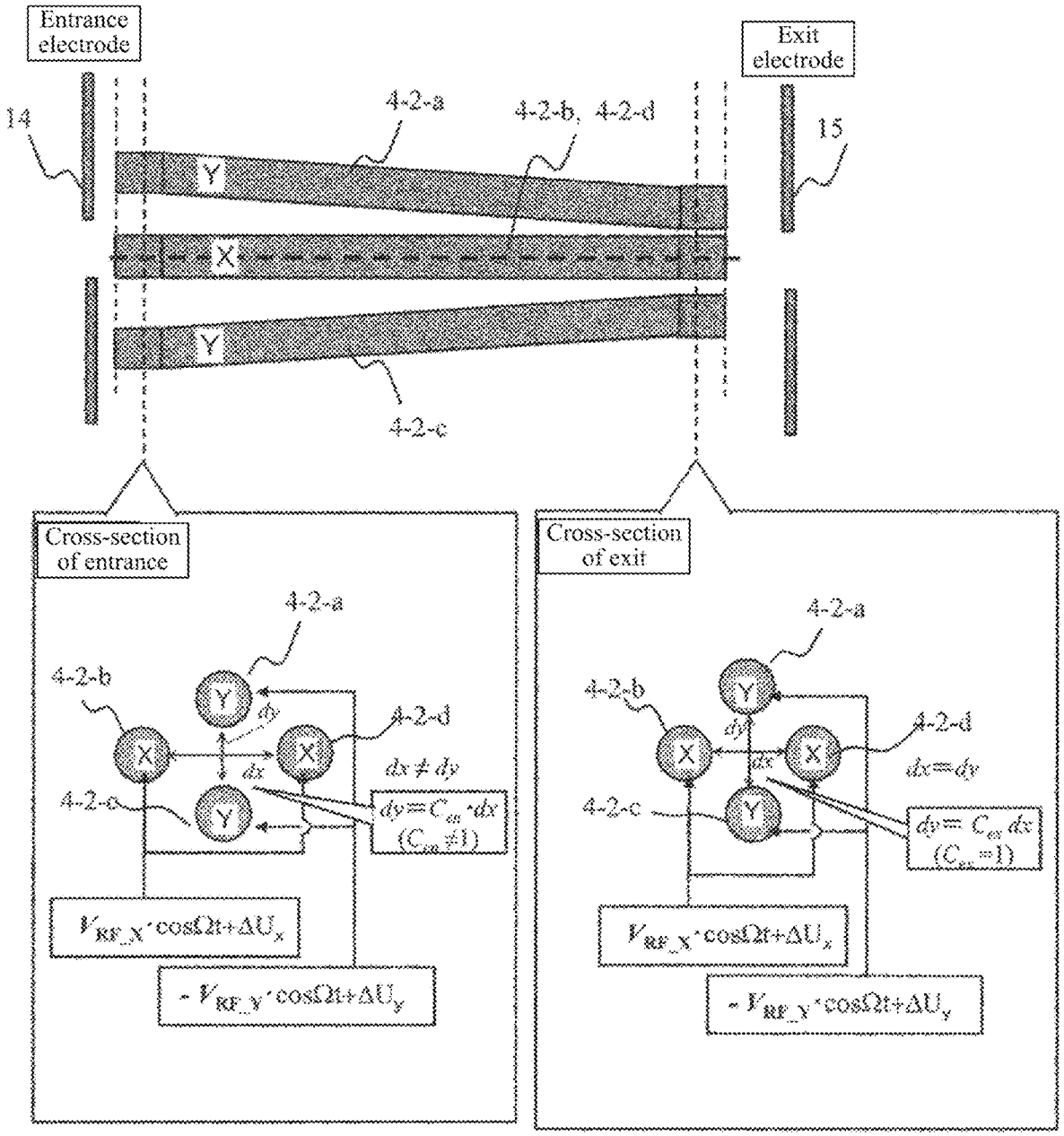
FIG. 19 is a schematic diagram illustrating a structure of a quadrupole electrode system and a voltage application method according to a fourth example of the invention.

Next, a fourth example will be described with reference to FIG. 19. Herein, as illustrated in FIG. 19, even in a case where an electrode system is an electrode system in which the distances dx and dy between the facing electrodes of the two respective pairs X and Y satisfy dx≠dy, the electrodes are disposed to substantially satisfy dx=dy at the exit of Q2. According to this example, even in a case where there is no correction of the amplitudes of the RF voltages based on the system near the exit, this example has similar effects to those of the above-mentioned examples, and therefore complicated voltage correction is unnecessary.

REFERENCE SIGNS LIST

1 is a preprocessing system, 2 is an ionization unit, 3 is a ion transport unit, 4 is a mass spectrometry unit, 4-1-*a*, 4-1-*b*, 4-1-*c*, and 4-1-*d* are four rod-like electrodes in a first quadrupole electrode system, 4-2-*a*, 4-2-*b*, 4-2-*c*, and 4-2-*d* are four rod-like electrodes in a second quadrupole electrode system, 4-3-*a*, 4-3-*b*, 4-3-*c*, and 4-3-*d* are four rod-like electrodes in a third quadrupole electrode system, 5 is an ion detection unit, 6 is a data processing unit, 7 is a display unit, 8 is a control unit, 9 is a voltage source, 10 is a user input unit, 11 is the whole tandem mass spectrometry system, 12 is an application voltage control content, 13 is a collision chamber, 14 is an entrance electrode of the second quadrupole electrode system, and 15 is an exit electrode of the second quadrupole electrode system.

The invention claimed is:

1. A mass spectrometer, comprising:

2n rod-like electrodes; and a control unit configured to apply a DC voltage U and a radio frequency voltage $V_{RF}$ cos Ωt to the rod-like electrodes to generate a high-frequency multipole electric field equal to or more than a quadrupole electric field between the rod-like electrodes, wherein:

a distance between at least a pair of facing rod-like electrodes of the rod-like electrodes at an entrance portion that ions enter is different from the distance at an exit portion from which ions are emitted;

the distance between the at least pair of the facing rod-like electrodes is gradually reduced from the entrance portion toward the exit portion;

in a case where distances between two pairs of electrodes facing each other near the exit portion are defined as dx and dy, respectively; and the control unit performs control so that amplitude values $V_{RF}x$ and $V_{RF}y$ of the radio frequency voltage $V_{RF}$ cos Ωt between the two pairs of the electrodes are different from each other in accordance with values of dx and dy.

2. A mass spectrometer, comprising:

2n rod-like electrodes; and a control unit configured to apply a DC voltage U and a radio frequency voltage $V_{RF}$ cos Ωt to the rod-like electrodes to generate a high-frequency multipole electric field equal to or more than a quadrupole electric field between the rod-like electrodes, wherein:

a distance between at least a pair of facing rod-like electrodes of the rod-like electrodes at an entrance portion that ions enter is different from the distance at an exit portion from which ions are emitted;

the distance between the at least pair of the facing rod-like electrodes is gradually increased from the entrance portion toward the exit portion;

in a case where distances between two pairs of electrodes facing each other near the exit portion are defined as dx and dy, respectively; and the control unit performs control so that amplitude values $V_{RF}x$ and $V_{RF}y$ of the radio frequency voltage $V_{RF}$ cos Ωt between the two pairs of the electrodes are different from each other in accordance with values of dx and dy.

3. The mass spectrometer according to claim 2, wherein:

the distance between the at least pair of the facing rod-like electrodes of the rod-like electrodes is gradually reduced from the entrance portion toward the exit portion, and a distance between another pair of facing rod-like electrodes is gradually increased from the entrance portion toward the exit portion; and the pair of the electrodes is disposed to be rotated at 90 degrees from the another pair of the electrodes.

4. The mass spectrometer according to claim 1, wherein:

the rod-like electrodes include a plurality of sets of rod-like electrodes facing each other; and the control unit applies the radio frequency voltage $V_{RF}$ cos Ωt to each set of the electrodes so that there is a difference in an amplitude value VRF of the radio frequency voltage $V_{RF}$ cos Ωt between the sets of electrodes.

5. The mass spectrometer according to claim 1, wherein in a case where dy/dx=C is satisfied, where C is a constant value, the control unit controls the amplitude values $V_{RF}x$ and $V_{RF}y$ so as to satisfy $V_{RF}y/V_{RF}x \propto 2C$.

6. The mass spectrometer according to claim 1, wherein in a case where dy/dx=C is satisfied, where C is a constant value, the control unit controls the amplitude values $V_{RF}x$ and $V_{RF}y$ so as to satisfy $V_{RF}y/V_{RF}x=2C$.

7. The mass spectrometer according to claim 1, wherein the rod-like electrodes are disposed to be inclined from the entrance portion toward the exit portion.

8. The mass spectrometer according to claim 1, wherein the facing electrodes are provided to be in parallel to each other at a distance of 1/100 or more but less than 2/3 of the whole length of the rod-like electrodes from the exit portion.

9. The mass spectrometer according to claim 1, wherein the distance between the rod-like electrodes is gradually changed in a stepwise manner from the entrance portion toward the exit portion.

10. The mass spectrometer according to claim 1, wherein distances between a plurality of pairs of facing electrodes are substantially the same near the exit portion.

11. The mass spectrometer according to claim 1, wherein the at least pair of the facing rod-like electrodes of the rod-like electrodes is disposed to have the same distance and be in parallel to each other.

12. The mass spectrometer according to claim 1, wherein:

a plurality of sets of the rod-like electrodes are connected in tandem; and in rod-like electrodes for dissociating ions with gas collision among the plurality of sets of the rod-like electrodes, a distance between at least a pair of facing rod-like electrodes of the rod-like electrodes at the entrance portion that ions enter is different from the distance at the exit portion from which ions are emitted.

13. The mass spectrometer according to claim 1, wherein the facing electrodes are provided to be in parallel to each other at least near the exit portion or the entrance portion.

* * * * *